United States Patent [19]

Essig et al.

[11] Patent Number: 4,695,816

[45] Date of Patent: Sep. 22, 1987

[54] THERMAL CUT-OUT

[75] Inventors: Willi Essig, Böblingen; Heinz Petri, Bretten, both of Fed. Rep. of Germany

[73] Assignee: E.G.O. Elektro-Geräte Blanc u. Fischer, Fed. Rep. of Germany

[21] Appl. No.: 930,862

[22] Filed: Nov. 13, 1986

[30] Foreign Application Priority Data

Nov. 14, 1985 [DE] Fed. Rep. of Germany ..... 3540414

[51] Int. Cl.[4] ..... H01H 37/48

[52] U.S. Cl. ..... 337/394; 337/382

[58] Field of Search ..... 337/394, 393, 392, 382, 337/388, 389, 390, 383

[56] References Cited

U.S. PATENT DOCUMENTS

| | | | |
|---|---|---|---|
| 1,806,651 | 6/1969 | Germany . | |
| 1,902,451 | 3/1933 | Johnson | 337/390 |
| 3,100,758 | 9/1982 | Germany . | |
| 3,906,424 | 9/1975 | Clancy et al. | 337/394 |

FOREIGN PATENT DOCUMENTS

| | | |
|---|---|---|
| 849440 | 9/1952 | Fed. Rep. of Germany . |
| 2748109 | 5/1979 | Fed. Rep. of Germany . |
| 3423086 | 1/1985 | Fed. Rep. of Germany . |
| 3333645 | 4/1985 | Fed. Rep. of Germany . |
| 208830 | 5/1940 | Switzerland . |

*Primary Examiner*—Harold Broome

*Attorney, Agent, or Firm*—Steele, Gould & Fried

[57] ABSTRACT

In a thermal cut-out for a heating means, e.g. a glass ceramic cooking unit, a signal switch and a circuit breaker are operated by means of a temperature sensor via a transfer member externally surrounding the switches and whereof the actuating member thereof located further from the temperature sensor is formed by an adjusting member, so that with the latter and also an adjusting member directly associated with the temperature sensor, a very precise setting is made possible. The transfer member is suspended in contact-free manner between oppositely acting springs and is therefore mounted in a substantially frictionless manner.

35 Claims, 3 Drawing Figures

THERMAL CUT-OUT

BACKGROUND OF THE INVENTION

The invention relates to a thermal cut-out or a heating system, particularly a glass ceramic cooking unit, with a substantially rod-shaped temperature sensor having an outer tube and an inner rod located therein having different expansion coefficients and which is provided for operating a signal switch arranged in a base and a circuit breaker also arranged in the base for switching off the heating means at a predetermined maximum temperature, a transfer member with actuating members connected to the base-side end of the inner rod acting on actuating points of both switches located roughly in the extension of the inner rod.

DE-OS No. 34 23 086 discloses a thermal cut-out of this type, in which the transfer member controlled by an inner rod constructed as a tension member, in the form of an actuating ram is passed through bores in the switch and is covered at both ends so as to be inaccessible from the outside. The actuating members are formed by the end face of a narrower ram part and the shoulder face of a larger diameter ram part, whose reciprocal spacing is fixed, so that no relative adjustment is possible through a direct spacing change between these two actuating members. Thus, for an adjustment of the signal switch independently of the adjustment of the circuit breaker, it is e.g. necessary to bend an end of a connecting lug carrying an opposite contact of said switch, which scarcely permits a precise adjustment. Admittedly other adjusting measures or means, such as adjustable screws, compression plates, etc. have been proposed for this purpose, but it is not possible as a result thereof to modify the relative spacing between the actuating members. DE-OS No. 33 33 645 discloses a thermal cut-out, in which one switch is operated by the inner bar via a reduction lever, but at the operating point at approximately 540° C. this gives extremely small operating paths if the temperature amplitude is made correspondingly small, so that the precise temperature limitation can then be impaired. However, with this construction, it is possible to very precisely adjust the reciprocal spacing of the two actuating members.

SUMMARY OF THE INVENTION

The problem of the present invention is to provide a thermal cut-out of the aforementioned type, particularly for two circuit radiant heaters, which in the case of a simple construction has relatively large operating paths and permits a relative adjustment between the two actuating members.

In the case of a thermal cut-out of the aforementioned type, according to the invention this problem is solved in that at least one of the actuating members is connected to an adjusting device provided on the transfer member permitting the modification of the reciprocal spacing of the actuating members. Thus, although the actuating members or points are located in linear succession roughly in the working direction of the actuating members and preferably in an extension of the inner rod, this space-saving construction ensuring relatively large actuating or operating paths also permits an adjustment of the spacing between the two actuating members. Particularly in conjunction with an adjusting device for the inner rod, this ensures a highly differentiated precise setting of the two switches of the thermal cut-out.

In a very simple embodiment, one actuating member is directly formed by an adjusting member, particularly an adjusting screw located roughly in the extension of the inner rod and which whilst requiring limited space is very easily accessible from the outside, so that readjustment is possible at any time. This is particularly the case if the adjusting device is associated with the actuating member remote from the inner rod.

A particularly advantageous further development, particularly of a thermal cut-out of the described type comprises that the substantially linearly movable transfer member is suspended in freely resilient manner and in particular contact-free manner with respect to the base, so that no frictional forces of a mounting act on the transfer member and consequently an extremely precise switching is ensured.

According to the invention the arrangement is appropriately such that at least one spring keeps the transfer member in the manner of a lever guide in its precisely aligned position and guides it over the operating path whilst maintaining this position. A leaf spring secured in the thermal cut-out casing on either side of the transfer member is particularly suitable for this, being fixed to the transfer member between its securing points, e.g. by riveting, spot welding, etc.

According to another feature of the invention the transfer member is constructed more particularly as a bow-shaped bridge passing round the switch in penetration-free manner and consequently, as no penetration openings in the switches are required, it is possible to use conventional switches without any modifications being necessary and without any weakening of the switch parts having to be feared as a result of openings. As a result and in a particularly simple manner the actuating members can be provided on the remote sides of the switch and are consequently very easily accessible. In the case of the switch being constructed as a snap switch, the catch springs thereof are located on the remote sides thereof, i.e. the two switches can be arranged mirror symmetrically to a median plane located between them.

As a further development of the invention the switches, particularly their catch springs have different operating differentials, preferably the operating differential of the signal switch being much smaller or of a minimum size, whereas the switching spring for the circuit breaker is subject to other laws due to its thermal stressing by self-heating. This is particularly the case if the circuit breaker is located close to the thermal cut-out.

This and other features of the preferred further developments of the invention can be gathered from the description and drawings and the individual features can be realized alone or in the form of subcombinations in an embodiment of the invention and in other fields.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
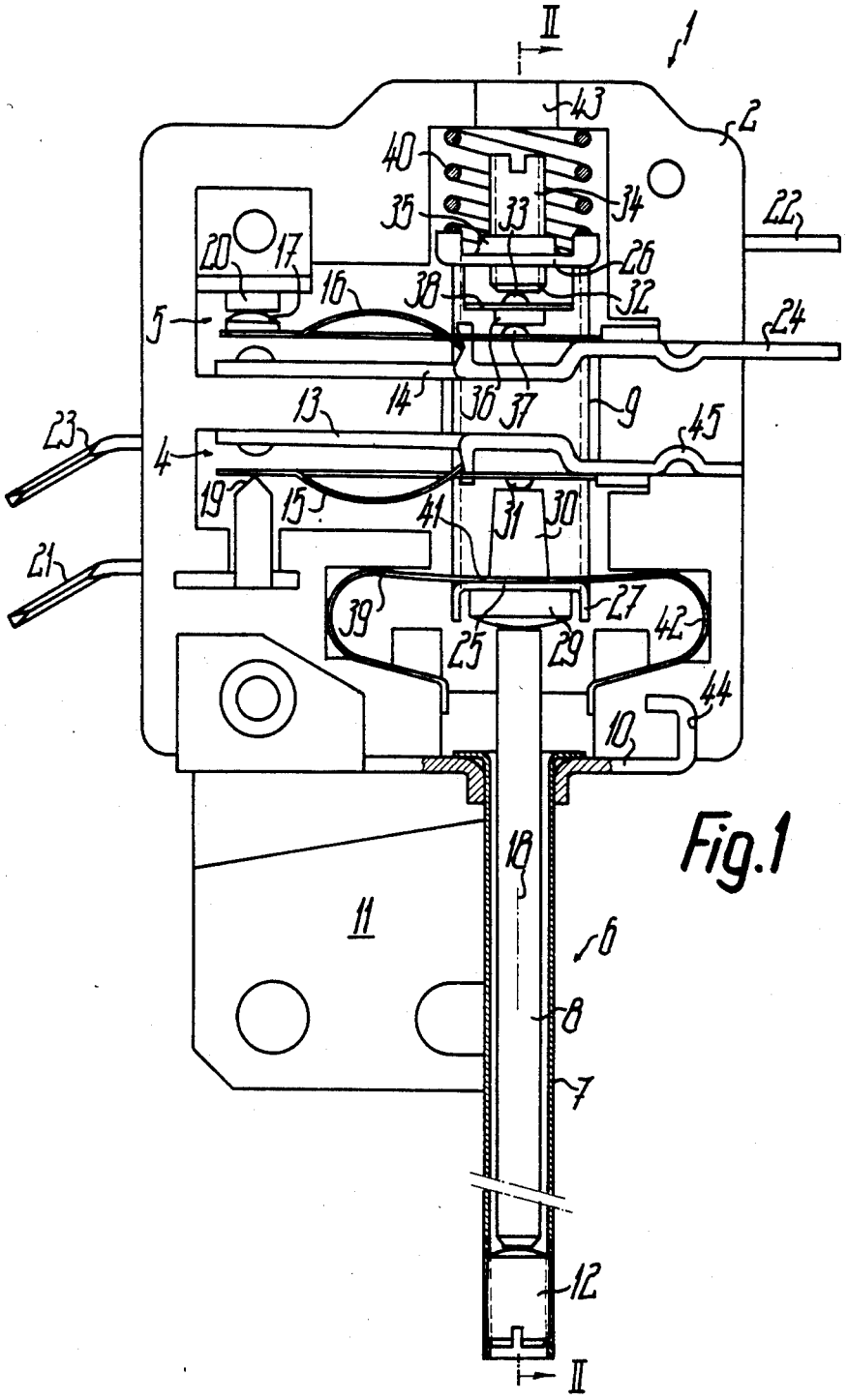
FIG. 1 A thermal cut-out according to the invention in a view with the casing open.
Figure 3:
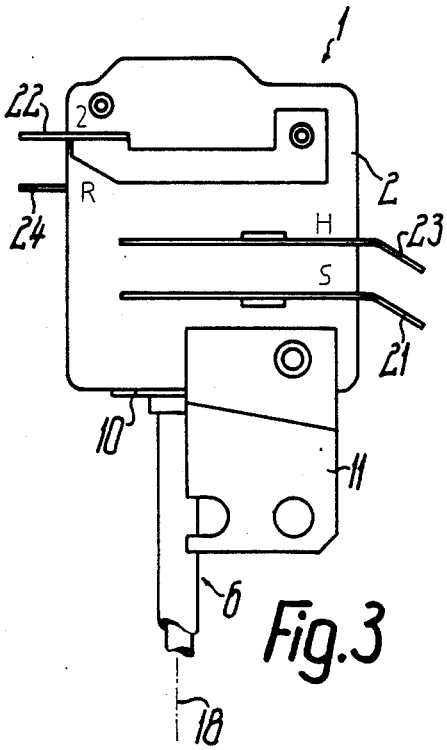
FIG. 3 The thermal cut-out in a view of the rear.
Figure 2:
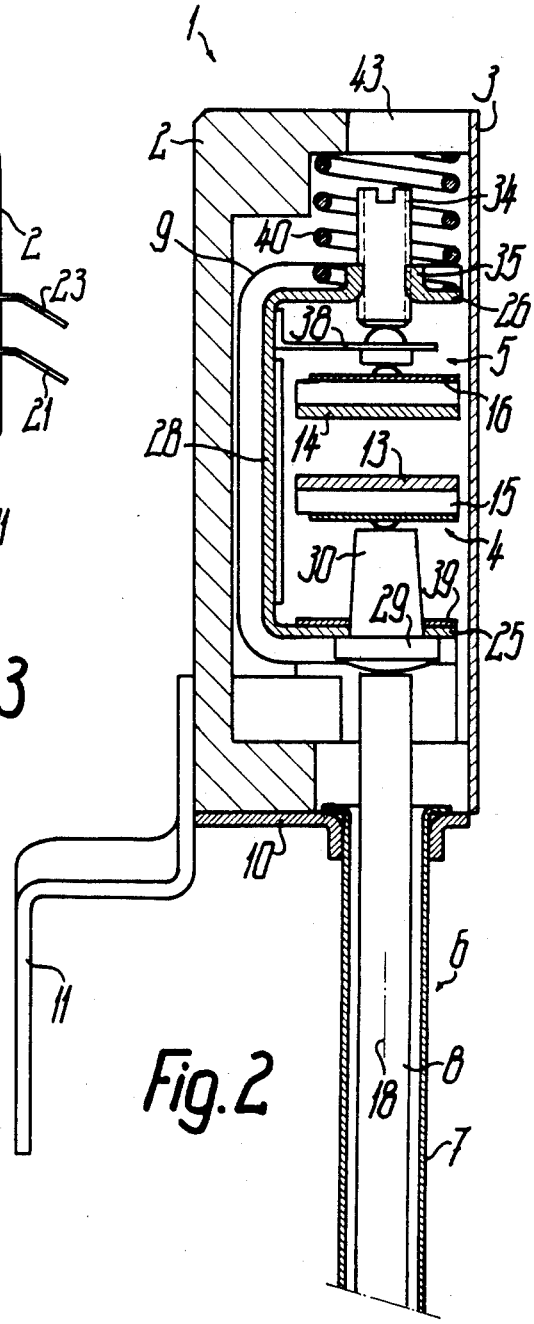
FIG. 2 A section along line II-II of FIG. 1.

The thermal cut-out 1 shown in FIGS. 1 to 3 has an insulating material casing 2, whose front can be opened and which can be closed by a plate-like, planar casing cover 3. The casing contains in directly adjacent, succeeding manner a circuit breaker 5 and a signal switch 4 in the form of substantially identically constructed snap switches. A rod-like, linear temperature sensor 6 is fixed to the casing 2 serving as a base and this essentially comprises a metal outer tube 7 and an inner rod 8 arranged in contact-free manner therein. Outer tube 7 is placed with its end shaped into a collar and located at casing 2 on the inside of a flange plate 10 traversed by outer tube 7 and centred in an annular flange. Flange plate 10 is fixed to casing 2 and is constructed in one piece with an offset fixing plate 11 projecting from the casing. Within casing 2, inner rod 8 is supported by means of its associated end on a freely resiliently suspended tranfer member 9 and its other end engages on an adjusting member 12, which in the form of a stud is adjustably and self-lockably guided in an inner thread in the associated end of outer tube 7. Each of the two switches 4, 5 has a strip-like switch support 13, 14 of roughly identical type and constructed as a punched bent part. Each switch support is provided with a catch spring formed by a leaf spring and which at its free end carries or forms a switching contact 17. The two switch supports 13, 14, including their catch springs 15, 16 are arranged in substantially mirror symmetrical manner to a median plane at right angles to the central axis 18 of the temperature sensor 8 or the operating direction, so that the catch springs 15, 16 are located on the remote sides of switch supports 13, 14. Casing-fixed opposite contacts 19, 20 are associated with the switching contacts and are connected as a component of or electrically conductively with connecting lugs 21, 22 projecting from the casing. Corresponding connecting lugs 23, 24 are also electrically conductively connected to the switch supports 13, 14 or in the case of support 15 constructed in one piece therewith. The two connecting lugs 21, 23 of one switch project over one narrow side of casing 2, whilst the connecting lugs 22, 24 of the other switch 5 project over the opposite narrow side of casing 2. The opposite contact 19 of signal switch 4 is constructed as a blade edge-like contact point, which electrically conductively cooperates in a direct manner, i.e. without a separate switching contact, with an end portion of the associated catch spring 15. This opposite contact 19 is appropriately constructed in one piece from sheet metal with the associated connecting lug 21.

As a freely suspended tranfer rod mounted in linearly movable manner, the transfer member 9 is constructed as a U-shaped stirrup of bridge which, in the vicinity of the stirrup legs 25, 26 and in the vicinity of the stirrup crosspiece parallel to temperature sensor 6 has U-cross-sections with outwardly directed U-legs, so that it can e.g. be made from relatively thin metal sheeting and still has a very high strength. The stirrup crosspiece 28 is located in a corresponding depression in the casing bottom on the side of switches 4, 5 remote from the open casing side and which pass into depressions for receiving catch springs and contacts, together with bearing springs. For supporting the inner rod 8 on the outside of the associated stirrup leg 25, the latter carries a bolt-like intermediate member 29, whose head is located between the U-legs 27 on the outside of stirrup leg 25 and which passes through the latter with a diameter-reduced shaft portion, the free end of the latter forming an actuating member 30 located in the central axis for the signal switch 4 positioned closer to temperature sensor 6. A stud-like actuating point 31 is associated with actuating member 30 between its securing points on the associated catch spring 15 and the end face of the actuating member 30 engages thereon. An actuating member 32 is also provided on the inside of the other stirrup leg 26, being formed by the associated end of an adjusting member 34 constructed as an adjusting screw, located in the central axis 18 of temperature sensor 6 and is guided in an outwardly projecting internally threaded sleeve 35 constructed in one piece with the stirrup leg 26 which is adjustable with an external thread and can be fixed by self-locking. By means of an actuating point 33 of an intermediate member 36, actuating member 32 acts on a stud-like actuating point 37, which is also provided between the securing zones on the associated side of catch spring 16. The intermediate members 29, 36 are appropriately made from an insulating material. Independently of the actuating member 32, intermediate member 36 is resiliently mounted in monostable manner in the operating direction on transfer member 9 through beng arranged on a leg freely projecting between actuating member 32 and actuating point 37 of an angular spring schackle 38 fixed to the inside of stirrup crosspiece 28.

Two spaced, oppositely acting springs 39, 40 are provided for the freely suspended, floating mounting of transfer member 9, whose stirrup legs 25, 26 overlap switches 4, 5 on their remote sides. The spring 39 constructed as a bow-shaped leaf spring located closer to temperature sensor 6 is rigidly fixed, e.g. by spot welding to the central section of its stirrup crosspiece 41 on the inside of the U-crosspiece of stirrup leg 25 and is traversed by actuating member 30. The stirrup legs 42 of spring 39 which are approximately U-shaped and directed counter to one another are inserted in pretensioned manner in casing 2 in such a way that they are precisely secured in position by multiple engagement on surfaces at an angle to one another and are so pretensioned that the stirrup crosspiece 41, even when released from the transfer member 9, still has a surface in the direction towards the other end of transfer member 9. The other, much more powerful spring 40 is constructed as a helical compression spring located in central axis 18 and which surrounds the adjusting member 34, being supported on the one hand between the U-legs on stirrup leg 26 and on the other hand on an opposite inner face of casing 2. This face is traversed by an opening 43 provided in the associated casing wall remote from temperature sensor 6, which connects onto casing cover 3 and through which at any time access can be obtained for readjustment purposes to adjusting member 34. Spring 40 presses the transfer member 9 or the spherically curved end face of intermediate member 29 against the inner rod 8 and together with spring 39 acts as a linear guide for transfer member 9.

Switch supports 13, 14, as well as the sheet metal fixing parts carrying the opposite contacts 19, 20 flange plate 10, springs 39, 40 and transfer member 9 are inserted in corresponding openings from the side of casing 2 open following the removal of casing cover 3 and are consequently substantially aligned and positionally secured, so that essentially no separate fixing parts are required. Between the ends of switch supports 13, 14 associated with the switching contacts is provided a web-like casing projection extending substantially up to casing cover 3 and on which engage said ends of switch supports 13, 14, whereby these ends can be used for supporting the catch springs when the switches are open. The areas of switch supports 13, 14 located on the other side of transfer member 9 are in each case provided with a profile 45 projecting towards the other switch support and which engages in a corresponding depression in the associated insertion slot of casing 2, so that the particular switch support is also precisely oriented in its longitudinal direction. For the positive reception of a profile edge of flange plate 10 located adjacent to temperature sensor 6, casing 2 has a correspondingly profiled retaining slot 44. On the side of temperature sensor 6 remote from said retaining slot 44, flange plate 10 is fixed by a rivet or the like to casing 2.

In the case of temperature rises, the inner rod 8 constructed as a compression member is shortened relative to outer tube 7, so that in accordance with FIG. 1, signal switch 4 closes e.g. at a temperature of approximately 60° C. and consequently switches on an optical or similar heat indicator showing that contact should not be made with the cooking unit or the like. In the case of a further temperature rise the actuating member 30 rises from the actuating point 31 and finally the circuit breaker 5 is opened at the set maximum temperature and consequently the heating means is switched off. The two switching or operating points are adjusted by means of the adjusting members 12, 13 located in a central axis 18.

What is claimed is:

1. A thermal cut-out (1) for a heating means, said cut-out having a substantially rod-like temperature sensor (6) for operating a signal switch (4) and a power switch (5) arranged in a base (2) for switching off the heating means at a predetermined maximum temperature, said temperature sensor having an outer tube (7) and an inner rod (8) located therein, a transfer member (9) continuately arranged to a socket-side end of the inner rod (8) being provided for acting on actuating points (31, 37) of both switches (4, 5) by actuating members (30, 32), said switches (4, 5) being substantially arranged in a length extension of the inner rod (8), wherein at least one of the actuating members (32) is operatively connected to an adjusting device provided on the transfer member (9) for varying the relative spacing between the actuating members (30, 32).

2. A thermal cut-out according to claim 1, wherein one actuating member (32) is directly formed by an adjusting member (34) located substantially in the length extension of the inner rod (8).

3. A thermal cut-out according to claim 1, wherein one actuating member (32) is directly formed by an adjusting screw.

4. A thermal cut-out according to claim 1, wherein the adjusting device is associated to an actuating member (32) remote from the inner rod (8).

5. A thermal cut-out according to claim 1, wherein the transfer member (9) is mounted substantially linear movable and is suspended in freely resilient manner.

6. A thermal cut-out according to claim 1, wherein the transfer member is suspended in contact-free manner with respect to the base.

7. A thermal cut-out according to claim 1, wherein the transfer member is mounted between two oppositely acting springs.

8. A thermal cut-out according to claim 1, wherein the transfer member is mounted between two springs acting as compression springs directly on the transfer member.

9. A thermal cut-out according to claim 1, wherein at least one spring acting on the transfer member is located in the vicinity of an associated end of said transfer member.

10. A thermal cut-out according to claim 1, wherein two springs acting on the transfer member are located each in the vicinity of one of two ends of said transfer member.

11. A thermal cut-out according to claim 1, wherein one spring remote from the inner rod is supported on an associated end face of the transfer member.

12. A thermal cut-out according to claim 1, wherein one spring for the transfer member remote from the inner rod is constructed as a helical spring surrounding an adjusting member (34).

13. A thermal cut-out according to claim 1, wherein one spring for the transfer member located closer to the inner rod is constructed as a leaf spring.

14. A thermal cut-out according to claim 1, wherein one spring for the transfer member located closer to the inner rod is constructed as a bow-shaped spring.

15. A thermal cut-out according to claim 1, wherein one spring located closer to the inner rod is constructed as a guide for the transfer member.

16. A thermal cut-out according to claim 1, wherein the transfer member is constructed as a bridge passing round the switches in penetration-free manner.

17. A thermal cut-out according to claim 1, wherein the transfer member is constructed as a bow-shaped bridge.

18. A thermal cut-out according to claim 1, wherein the actuating members are arranged on the transfer member in oppositely directed manner.

19. A thermal cut-out according to claim 1, wherein the actuating members are arranged on the transfer member and are directed towards one another.

20. A thermal cut-out according to claim 1, wherein the actuating members are arranged on bow legs of the transfer member.

21. A thermal cut-out according to claim 1, wherein one spring located closer to the inner rod is fixed to a side of the transfer member remote from the inner rod.

22. A thermal cut-out according to claim 1, wherein one spring located closer to the inner rod is fixed with a bow crosspiece to the transfer member.

23. A thermal cut-out according to claim 1, wherein one spring for the transfer member located closer to the inner rod is traversed by the associated actuating member.

24. A thermal cut-out according to claim 1, wherein an insulating intermediate member is located between an actuating member adjustably arranged on the transfer member and the actuating point of the associated switch.

25. A thermal cut-out according to claim 1, wherein an insulating intermediate member is located between an actuating member (32) adjustably arranged on the transfer member and the actuating point of the associated switch, said intermediate member being fixed independently of the actuating member and in freely projecting manner by a spring schackle to the transfer member.

26. A thermal cut-out according to claim 1, wherein at least one actuating point is provided directly on a catch spring of the associated switch constructed as a snap switch.

27. A thermal cut-out according to claim 1, wherein both switches are constructed as snap switches and wherein both switches are arranged with oppositely directed catch springs.

28. A thermal cut-out according to claim 1, wherein the switches have different operating differentials.

29. A thermal cut-out according to claim 27, wherein the catch springs of the switches have different operating differentials.

30. A thermal cut-out according to claim 1, wherein the switches have different operating differentials and wherein the operating differential of the signal switch is much smaller.

31. A thermal cut-out according to claim 1, wherein one switch associated with the actuating member adjustably arranged on the transfer member is in the form of a power switch.

32. A thermal cut-out according to claim 1, wherein a switch remote from the inner rod is in the form of a power switch.

33. A thermal cut-out according to claim 1, wherein the inner rod is in the form of a pushing member.

34. A thermal cut-out according to claim 1, wherein the inner rod is supported in the vicinity of its end remote from the base on an adjusting member.

35. A thermal cut-out according to claim 1, wherein it is provided for a glass ceramic cooking unit.

* * * * *

UNITED STATES PATENT AND TRADEMARK OFFICE

CERTIFICATE OF CORRECTION

PATENT NO. : 4,695,816

DATED : September 22, 1987

INVENTOR(S) : Willi Essig and Heinz Petri

It is certified that error appears in the above-identified patent and that said Letters Patent is hereby corrected as shown below:

Column 5, line 59 delete "linear" and insert --linearly--.

Signed and Sealed this

Twenty-fifth Day of October, 1988

*Attest:*

DONALD J. QUIGG

*Attesting Officer*

*Commissioner of Patents and Trademarks*